US005396322A

United States Patent [19]

Lawrence et al.

[11] Patent Number: 5,396,322

[45] Date of Patent: Mar. 7, 1995

[54] SINGLE FEED PATH DUAL SHEET RECEIVER

[75] Inventors: Frederick J. Lawrence, Tustin; George M. Cross; William D. Baker, both of Irvine; Michael D. Dice, Santa Ana, all of Calif.

[73] Assignee: Gradco (Japan) Ltd., Tokyo, Japan

[21] Appl. No.: 147,506

[22] Filed: Nov. 5, 1993

[51] Int. Cl.[6] ..... G03G 21/00; B65H 39/10

[52] U.S. Cl. ..... 355/323; 271/291; 271/297

[58] Field of Search ..... 270/58; 271/290, 291, 271/297; 355/308, 321, 323

[56] References Cited

U.S. PATENT DOCUMENTS

| | | | |
|---|---|---|---|
| 4,116,429 | 9/1978 | Van Buskirk et al. | 271/2 |
| 4,228,995 | 10/1980 | Breuers et al. | 271/297 X |
| 4,368,972 | 1/1983 | Naramore | 355/323 |
| 4,650,177 | 3/1987 | Hauger et al. | 271/290 X |
| 4,650,178 | 3/1987 | Steele et al. | 271/297 X |
| 4,691,914 | 9/1987 | Lawrence | 271/297 |
| 4,843,434 | 6/1989 | Lawrence et al. | 355/72 |
| 4,986,529 | 1/1991 | Agarwal et al. | 271/291 |
| 5,013,028 | 5/1991 | Tajima et al. | 271/297 X |
| 5,201,518 | 4/1993 | Isoda | 271/297 X |
| 5,253,028 | 10/1993 | Gonda et al. | 355/321 X |

*Primary Examiner*—Fred L. Braun

[57] ABSTRACT

A random access sheet receiver has pairs or sets of trays for receiving sheets arranged in vertically spaced relation and extending horizontally in opposite directions from a central sheet path defined by gates and feed rollers and extending vertically between the sheet inlet ends of the trays. Each set of trays may have one or a plurality of trays of selected sheet capacity. A double acting actuator is employed to selectively actuate any gate or deflector randomly to direct sheets in a selected direction into a selected tray.

10 Claims, 6 Drawing Sheets

Fig. 6
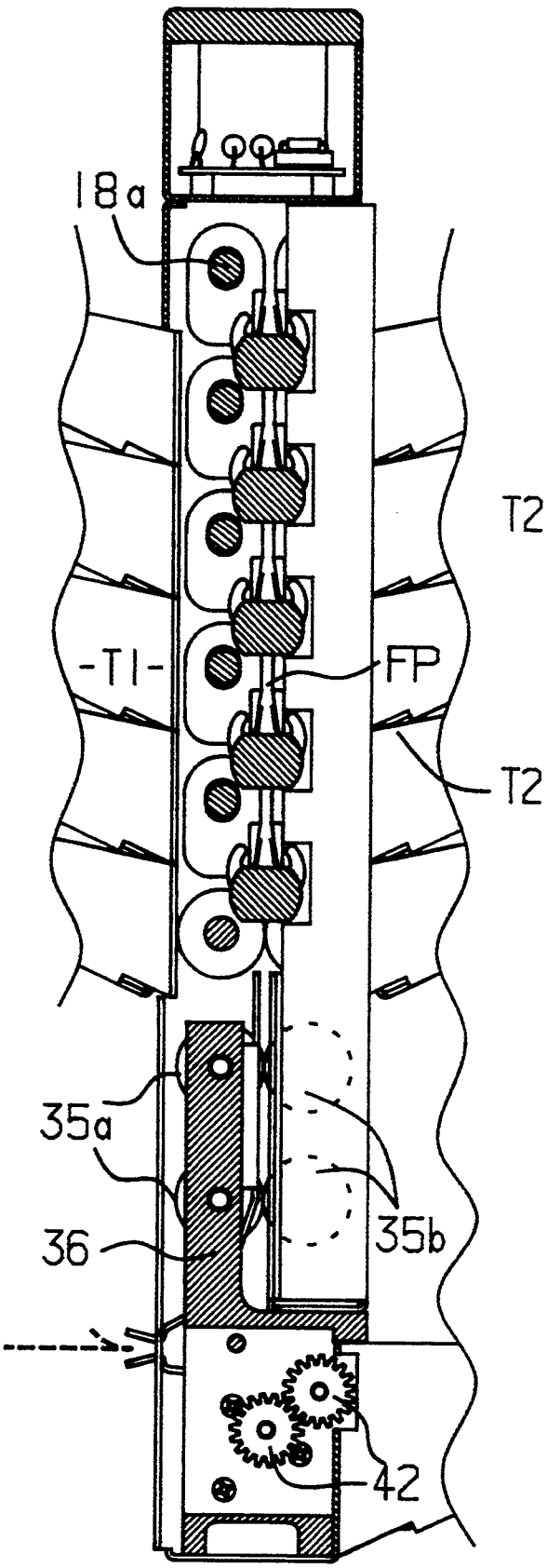
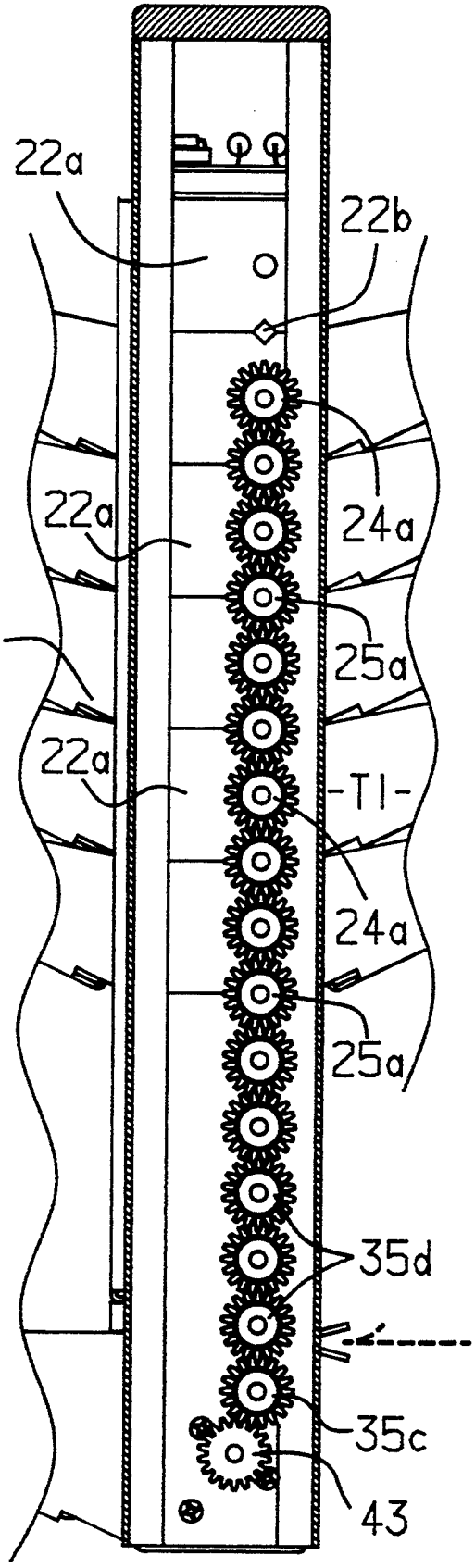
Fig. 7

Fig. 8a
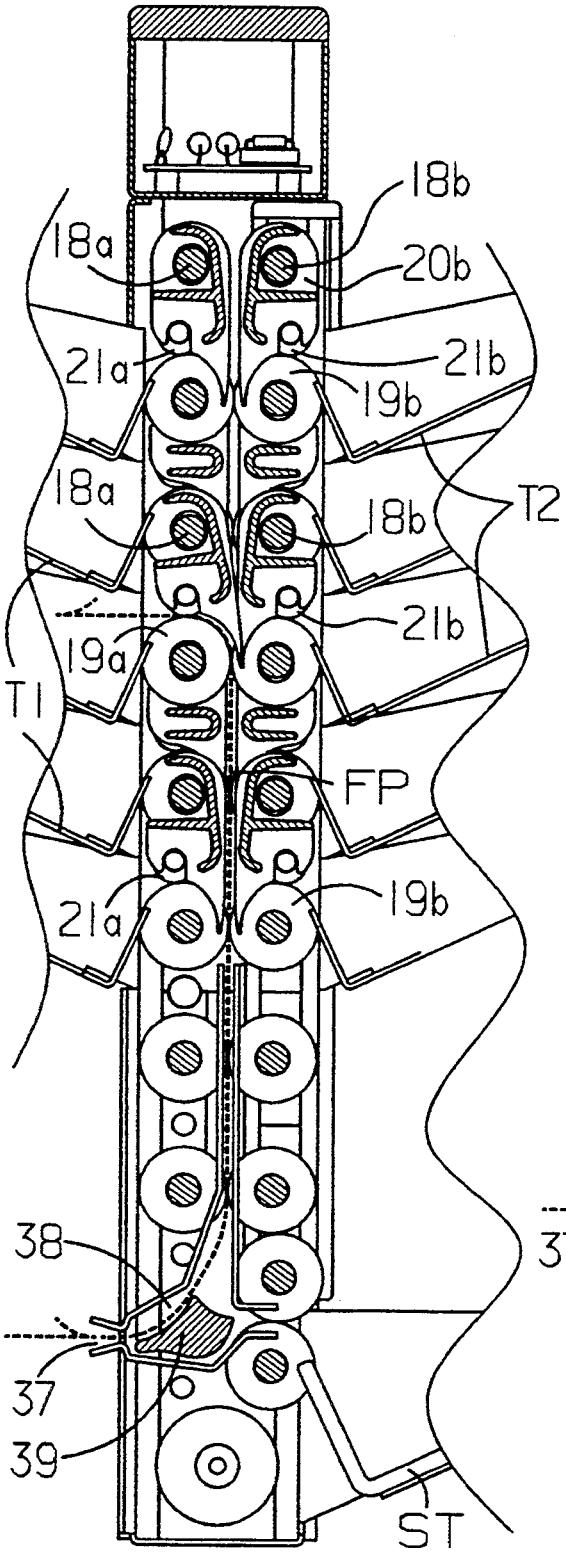
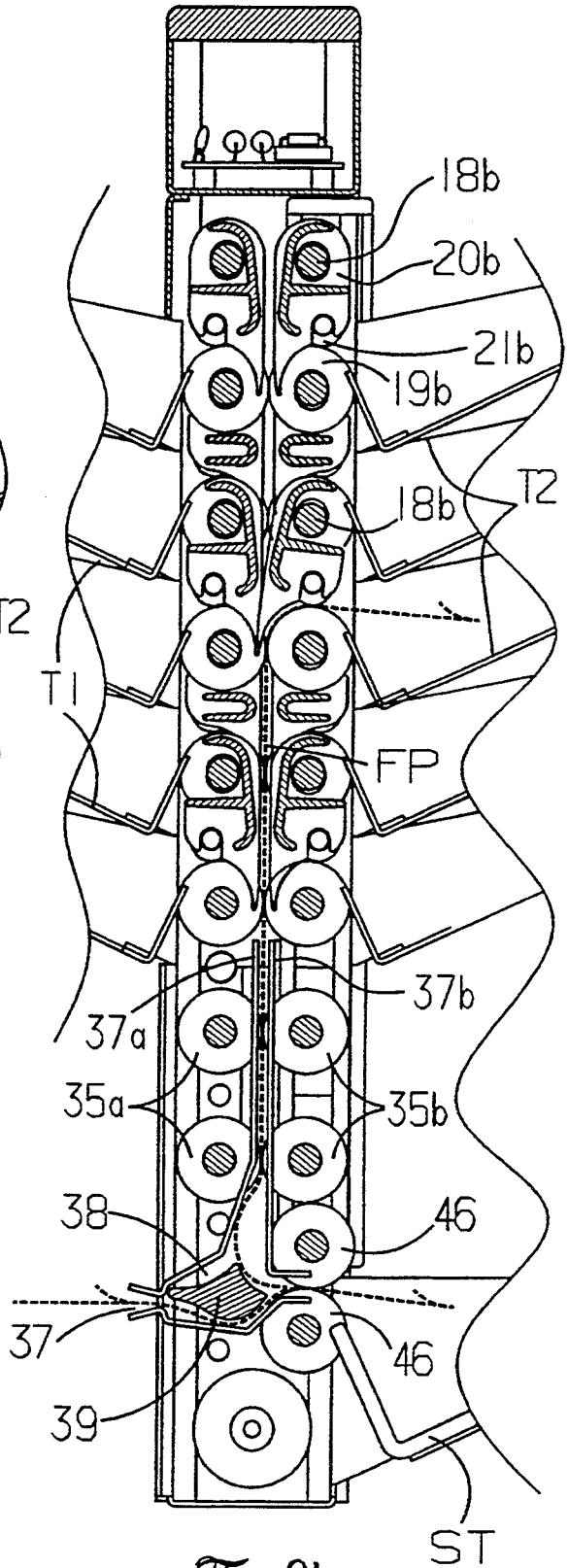
Fig. 8b

SINGLE FEED PATH DUAL SHEET RECEIVER

BACKGROUND OF THE INVENTION

In the use of office printers, there is a need for sheet receiving apparatus which is capable of segregating the output in categories involving set separation of multiple copies, job separation of multiple jobs and user or recipient separation, particularly in the case of networked printers.

Such devices are commonly referred to as mailboxes or random access sorting machines in which the printed material is not necessarily directed into successive trays as in the typical sorting or collating machines employed, say with office copiers.

Random access sorting devices useful as mailboxes may take various forms. For example, in U.S. Pat. Nos. 4,691,914 and 3,937,459 there are disclosed forms of such sorters which may be used in conjunction with a copying machine in a sorting or collating mode in which successive sheets of copy from the copier are deflected from a sheet transport into successive trays of a vertically spaced set of trays. Such sorters are also useful as job separators when used in a job separation mode, as well as being useful as random access sorters or mailboxes because the sheet deflectors may be actuated at random, under the control of a printer.

Another type of random access sorter, as exemplified in U.S. Pat. No. 4,843,434, may also be operated to receive sheets from a copier for sequentially collating the copies or separating jobs. However, inherently, such sorters are not truly random access in their operating mode because the sheet deflector which travels sequentially in a normal collating operation in association with a copier must also be moved sequentially from tray to tray when operating as a random access mailbox. Such sequential tray to tray movement of a deflector or an actuator, therefore, is not well suited for use in mailboxing in the case that the printer operates at such a speed as to afford only a short inter-document gap between successive sheets and the deflector must move from one selected tray to another tray, at random, during the period permitted by the rate of travel of successive sheets. In the alternative, the production rate of the printer may be compromised to afford adequate time intervals between sheets to enable shifting of the sheet deflector, but impedance of the copier feed rate is objectionable.

With the foregoing in mind it is clear that, particularly in the case of printers which operate at speeds of, say, 15 plus pages per minute, the preferred form of receiver or mailbox is of the fixed bin type with deflectors at each tray that can be actuated to and from the positions forming part of the sheet path for deflecting sheets from the sheet path into the associated tray, because operation of the deflector can be instantaneous, as by means of a solenoid, as disclosed in the aforementioned U.S. Pat. No. 4,691,914.

U.S. patent application Ser. No. 849,223, filed Mar. 10, 1992, now U.S. Pat. No. 5,328,170, and co-owned herewith, discloses an actuator for gate type sorters which operates uni-directionally to mechanically open gates for random access to the trays. However, here again, there is a period of time required between sheets necessary to allow movement up or down of the actuator to position it for actuation of a particular or selected gate.

In U.S. patent application Ser. No. 044,439, filed Mar. 29, 1993, now U.S. Pat. No. 5,344,131, and co-owned herewith, there is disclosed a random access sorter or mailbox which utilizes features of U.S. Pat. Nos. 3,937,459 and 4,691,914 to utilize paper controlling feed rollers and compact gate devices in a relatively short assembly for a given number of trays of a given maximum sheet capacity per tray.

Another problem involved in the practical application of mailboxing sheet receivers to the modern office printers involves size and expense. As laser printer technology has evolved, the size and cost of printers have both been reduced, so that the cost of a mailbox, as compared with the cost of a host printer has become more of a problem, as has the aesthetic balance of the mailbox and printer, because incorporation of the preferred, fixed bin, random access technology in an inexpensive and small package is a difficult task, due to the inherent number of parts and operating mechanisms and the vertical space occupied by, say, up to twenty bins, combined with a stacker for output which does not require mailboxing or even sorting.

In order to avoid excessive height, it has heretofore been known to duplex sorter devices to double the capacity, either by bypassing the printer output from a first sorter to a second sorter in a horizontally spaced pair, or mounting a pair of sorters in back to back relation. However, doubling the capacity in such ways more than doubles the cost because of the need for selective feeding of sheets to one or the other of the two sorter assemblies.

SUMMARY OF THE INVENTION

The present invention relates to a sorter construction with a random access mailboxing mode of operation, but which is relatively inexpensive and compact, so as to be reasonably economically and aesthetically compatible with office printers.

In accomplishing the foregoing, the present invention utilizes sets of trays which extend oppositely and horizontally from a central paper path for carrying sheets vertically from an inlet to the respective trays, combined with a randomly operated, bi-directional deflector system, so that the successive sheets can be directed to a randomly selected tray of either set of oppositely extended trays.

In addition, the structure is modular so that a selected number of trays may be employed at either side of the central paper path, thereby enabling the assembly to be versatile as to the number of total trays on either side of the paper path. Thus, at one side of the paper path may be a selected number of trays equally vertically spaced to receive one number of sheets per tray, while at the other side of the paper path a lesser number of trays may be spaced at larger vertical spacing to receive either a larger number of sheets requiring set separation or larger numbers of sheets which simply require stacking.

More specifically the paper path extending vertically between the vertically spaced and oppositely, horizontally extended trays is defined by a plurality of oppositely pivotal gates or deflectors associated with a common, central sheet feed path. This structure allows the assembly to be low in profile as compared with the same number of trays, of the same sheet capacity, disposed in a single vertical stack, and the tray supporting structure is smaller and less costly than tandem or other multiple sorter arrangements.

In addition, the use of oppositely acting gates or deflectors permits utilization of half the number of gate or deflector actuators when they are oppositely actuated by a single but double acting or bi-directional actuator.

In accomplishing the foregoing, in a specific sense, the present invention provides for utilization of the modular feed roll and gate construction of the aforementioned application Ser. No. 044,439 in an arrangement in which a pair of such assemblies are disposed adjacent to one another with the trays extending in opposite directions from the respective assemblies, the gates are operated in opposite directions, and a common sheet feed path is formed by the co-action of rollers of the respective units, and a common actuator is employed to selectively actuate one of the gates at each pair to divert the sheets to one or the other of the trays.

Other features and advantages of the invention will be hereinafter described or will become apparent from the following detailed description taken together with the drawings forming a part hereof.

BRIEF DESCRIPTION OF THE DRAWINGS

FIG. 6 is a vertical section on the line 6—6 of FIG. 2 in the region of the gate actuators, with the gates in position for through feeding of sheets;

FIG. 7 is a vertical section on the line 7—7 of FIG. 2 showing the sheet feed drive;

FIG. 8*a* is a vertical section on the line 8—8 of FIG. 2 showing the sheet feed path with one gate opened to divert a sheet in one direction into a tray;

FIG. 8*b* is a view like FIG. 8*a*, but showing the sheet feed path for inverting a sheet and with a gate open to divert a sheet in the other direction into a tray;

DESCRIPTION OF THE PREFERRED EMBODIMENT

Figure 2:
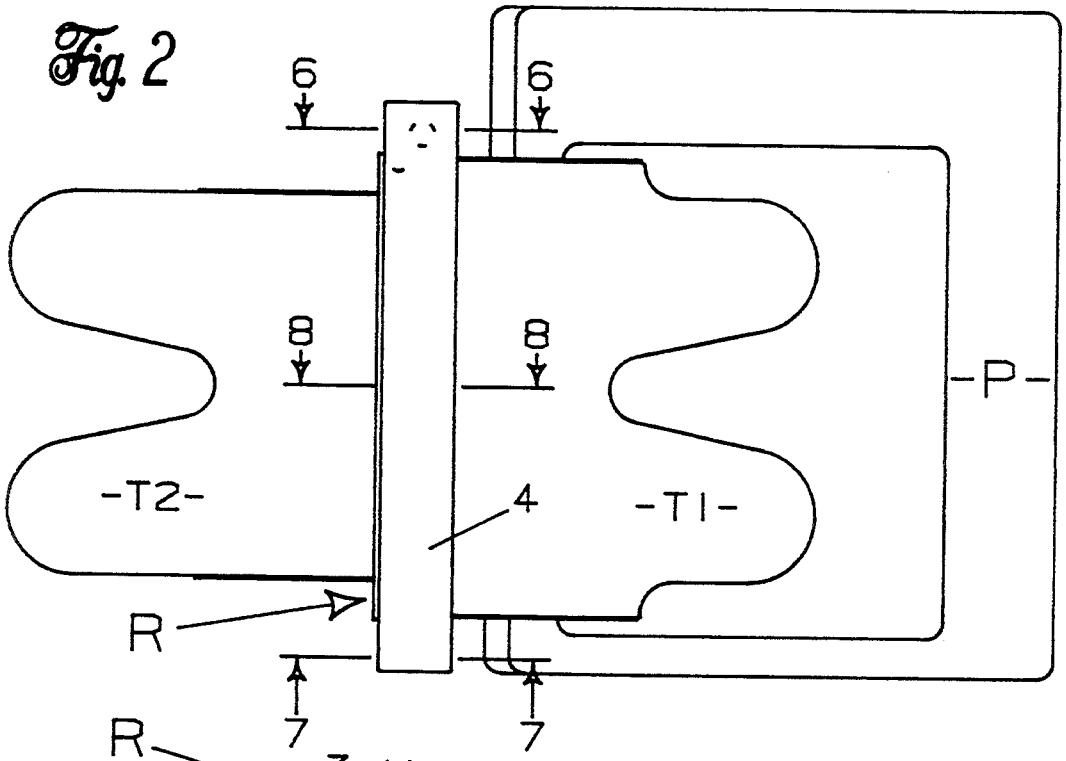
FIG. 2 is a top plan thereof.
Figure 1:
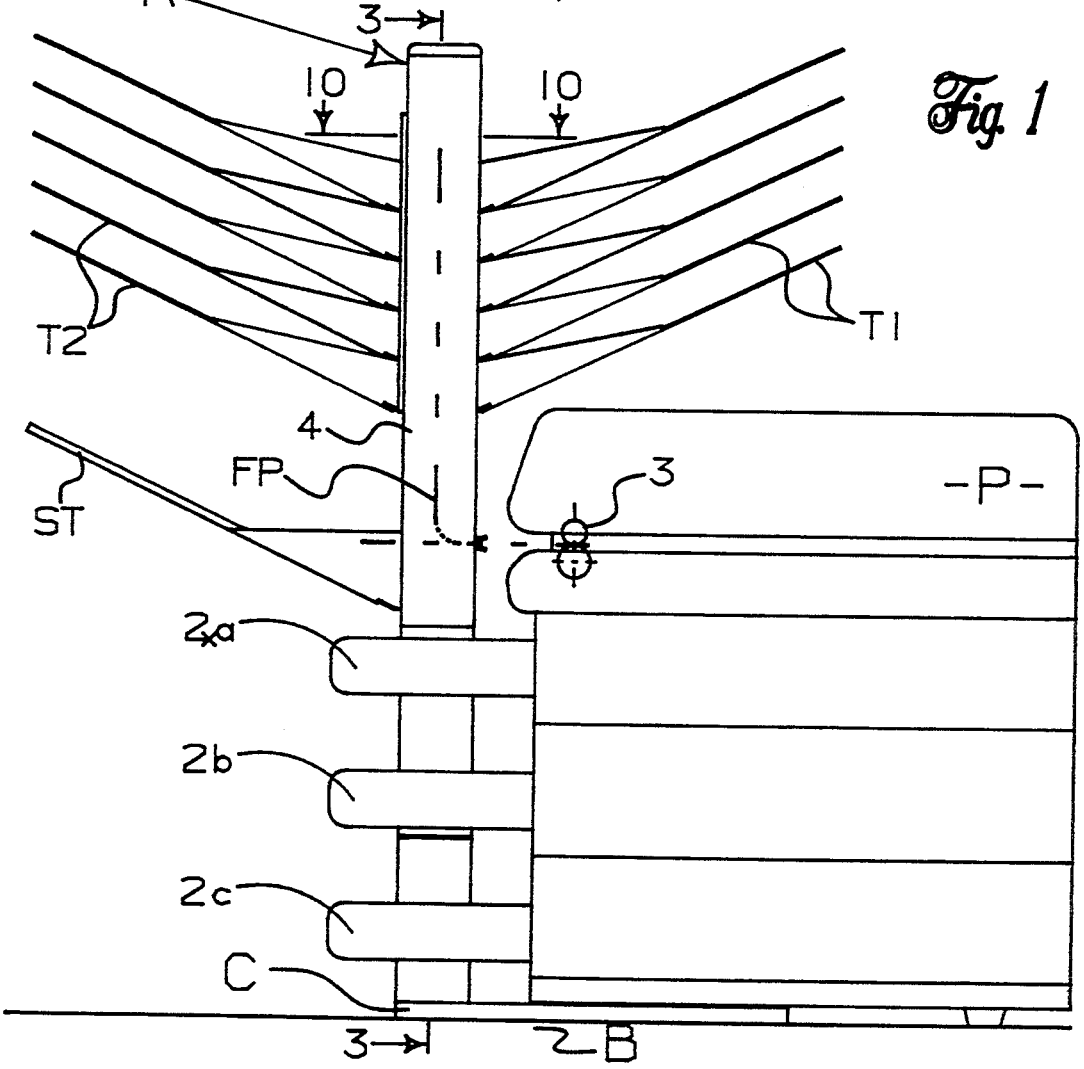
FIG. 1 is a side elevation showing a mailbox in accordance with the invention applied to an office printer.

In the illustrated embodiment, referring first to FIGS. 1 and 2, an office printer or copier P is mounted on a suitable base B and is adapted to supply printed sheets to a sheet receiver or mailbox R mounted on a suitable base C on which the printer is shown as resting to hold the base in place. The base C supports the mailbox assembly adjacent to the printer to receive paper sheets following printing of the sheets supplied from a number of cassettes 2*a*, 2*b* and 2*c*.

The printer P is adapted to supply sheets by output rolls 3 to a transport in the lower end of a tower 4 which has feed means later to be described so that sheets are fed in the path FP indicated by the broken line which turns upwardly for delivery of the sheets to the respective trays T1 and T2, as will be later described, by the sheet transporting and deflecting and tray support tower assembly 4. The trays extend horizontally at an incline from the tower 4 and in opposite directions to selectively receive sheets from the feed path. A bottom stacker tray ST is provided to receive from feed rolls 3 sheets which are not to be delivered to the tower 4 for distribution to trays T1 or T2.

Figure 3:
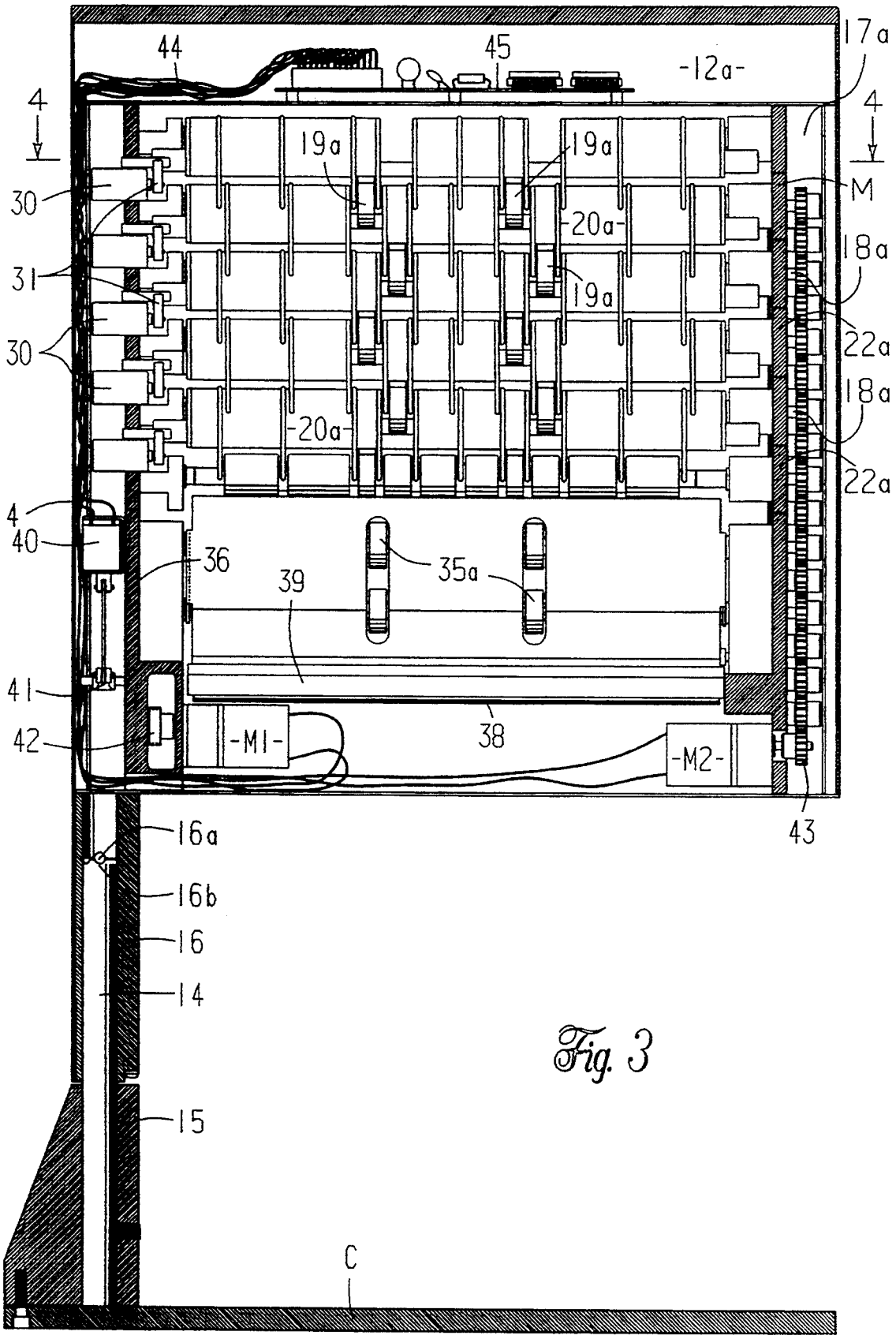
FIG. 3 is an enlarged vertical section on the line 3—3 of FIG. 1, showing sheet transport and gate side of one of the sorter assemblies.
Figure 10:
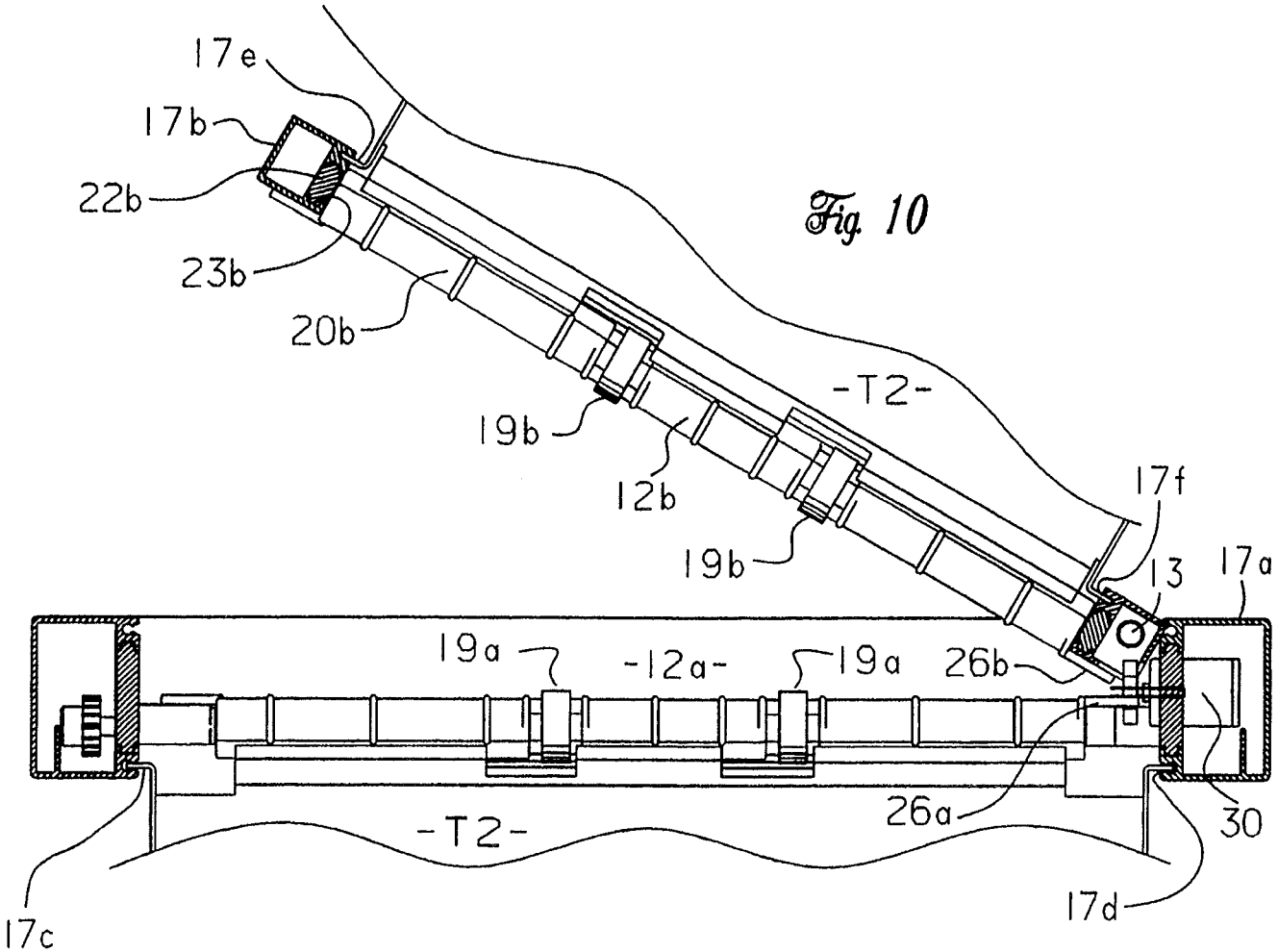
FIG. 10 is a fragmentary horizontal section on the line 10—10 of FIG. 1 showing the assembly opened for paper jam clearance.
Figure 9A:
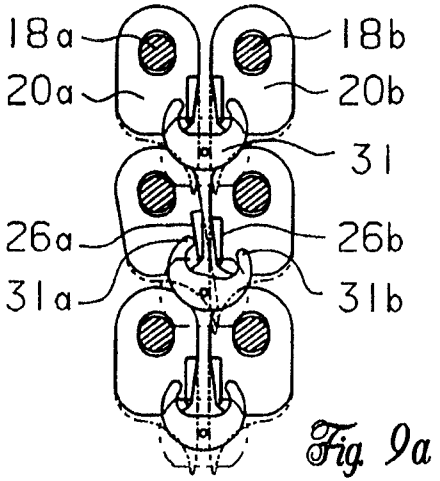
FIG. 9*a* is a fragmentary detail view showing the alternately operable gate actuator mechanism operated to divert a sheet as shown in FIG. 8*a*.
Figure 9B:
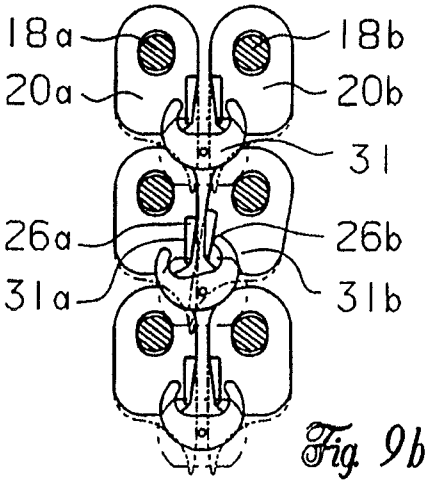
FIG. 9*b* is a view like FIG. 9*a*, but showing the gate actuator mechanism operated to divert a sheet as shown in FIG. 8*b*.

As seen in FIGS. 3–10 the tower 4 comprises a sheet transport and deflecting system including transport deflecting sections 12*a* and 12*b*, which define, as later described, the sheet feed path FP, and pivoted at 13 on a vertical post to enable the assemblies 12*a* and 12*b* to be separated (as shown in FIG. 10) at the sheet feed path FP extending vertically between these two components. In addition, the tower assembly 4 is mounted to swing on a vertical pivot post 14 from a position to receive sheets to an out of the way position to allow access to the top of the printer. As seen in FIG. 3, the post 14 extends upwardly from a post support 15 fixed on the base C. Extending downwardly from the tower 4 is a sleeve 16 rotably disposed on the upper end post 14 and resting upon the post support 15. Extended through the bore of the sleeve 16 is a pin 16*a* adapted to engage in a notch 16*b* at the top of post 14 to hold the tower assembly in the position shown in FIGS. 1 and 2 but to permit the tower to swing about the post 14 to the out of the way position as mentioned above.

In the feed path FP the sheets of paper S, as seen in FIGS. 8*a* and 8*b*, are adapted to be fed upwardly for ultimate delivery to the trays T1 or T2, either in sequence as in the usual collation of successive copies of the pages of a document being copied, in a book mode as in the collection of copies of a multiple page document supplied from the printer, or randomly, in the case that the apparatus is to be employed as a mailbox. Also, sheets exiting the printer may be fed through the tower 4 to the stacker tray ST, as will be later described.

Figure 4:
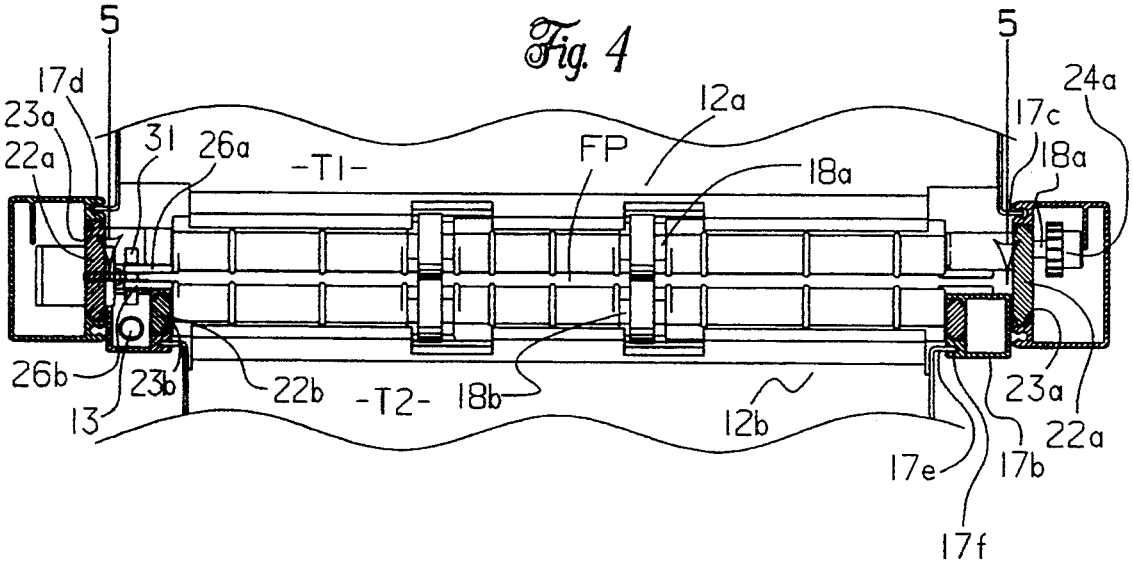
FIG. 4 is a horizontal section of the assembly taken on the line 4—4 of FIG. 3.
Figure 5:
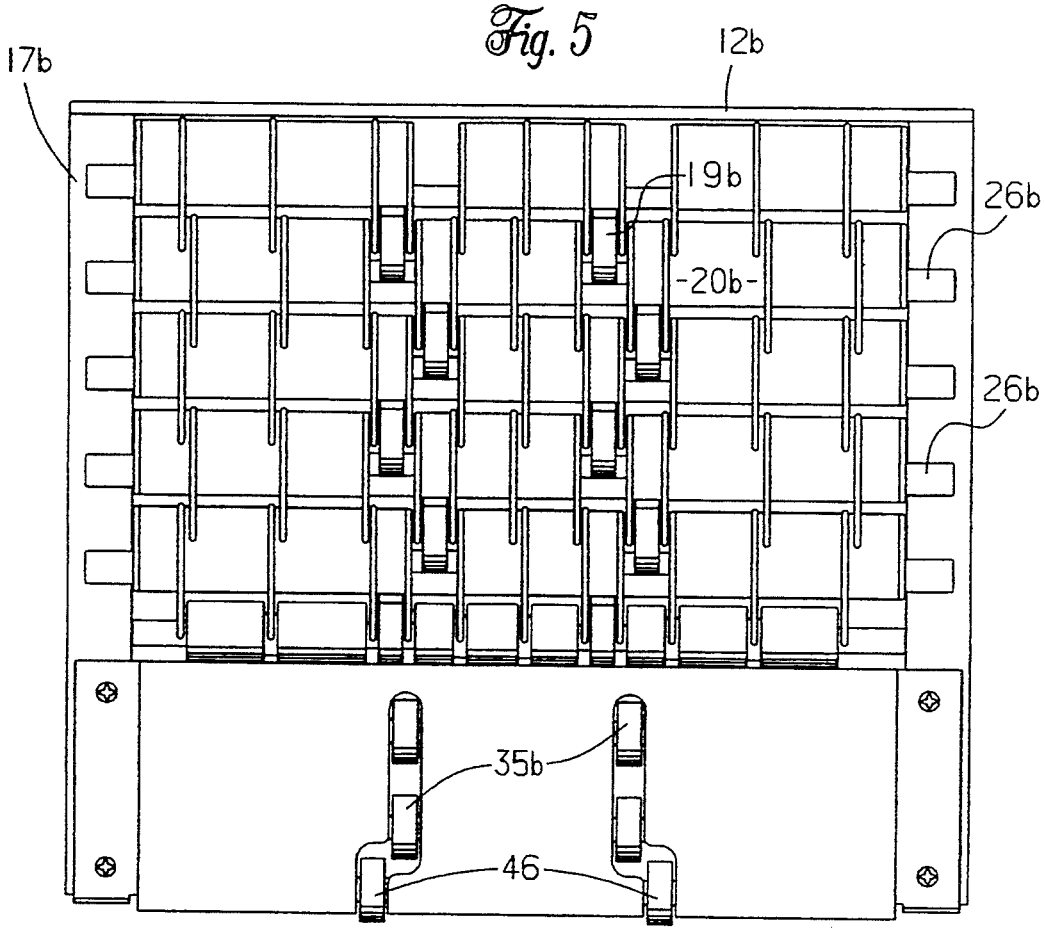
FIG. 5 is a vertical section on the line 5—5 of FIG. 4 showing the opposite sheet transport and gate assembly from that of FIG. 3.

Referring to FIGS. 4–8, the tower assembly 4 is illustrated in FIGS. 4 and 6–8, and the respective sections 12*a* and 12*b* are illustrated in FIGS. 3 and 5 as viewed at their inner sides where they oppose one another at the feed path FP.

It will be seen that the transport and deflecting section 12*a* comprises a frame structure 17*a* in which are stacked a suitable number of modules M. Each such module includes an elongated driven shaft 18*a* on which is mounted a pair of horizontally spaced friction sheet feeding rolls 19*a*. Each shaft 18*a* also has associated with the feed rolls 19*a* a pivoted gate 20*a*, and each gate 20*a* rotatably supports a nip roll 21*a* which is adapted to cooperate with the associated roll 19*a* to provide a positive drive of a sheet into the tray T1.

In each module the shaft 18*a* is rotatably supported at its opposite ends in blocks 22*a* which are adapted to be vertically slidably inserted into slots 23*a* in the frame structure 17*a*.

The frame structure 17*a*, as best seen in FIG. 4, is formed from opposing posts which are elongated extrusions, the length of which can be determined by the number of modules M which are to be utilized in the gate section 12*a*. Also, due to this construction, the trays T1 can be easily assembled with the frame members 17*a* by the provisions of side flanges 17*c* on the trays engageable in grooves 17*d* in the extended frame members. This enables, in addition, the selective provision of a tray T1 per module, so that the number of trays may be varied. This means, for example that different numbers of trays T1 or T2 may be employed to accommodate different quantities of sheets per tray.

In order to drive the shaft 18*a* of each module M, each shaft, at the right hand end as seen in FIG. 4 and in FIG. 7, has a gear 24*a* and in mesh with the gears 24*a* is an idler gear 25*a* rotatable on a stub shaft adapted to be mounted between adjacent blocks in a recess 22*b* (one of which is seen in FIG. 7).

The transport and deflector section 12*b*, as best seen in FIGS. 4 and 8 includes vertical side frame members 17*b* in which roller support shafts 18*b* are supported, with feed rollers 19*b* opposing feed rollers 18*a* for engagement of the sheets of paper in feed path FP. Associated with each roller 18*b* is a gate 20*b* and a nip roll 21*b*.

Thus, when the transport and deflector sections 12*a* and 12*b* are closed to bring the feed rolls 19*a* and 19*b* into cooperative sheet feeding relation, friction between them drives rolls 19*b* as the rolls 19*a* are driven by the gearing previously described. In this case, however, when a gate 20*b* is opened, as seen in FIG. 8*b*, a sheet is deflected to a tray T2 from sheet feed path FP defined between the sections 12*a* and 12*b*.

Here again, the construction is modular and the shafts 18*b* are supported at their opposite end in blocks 22*b* installed in grooves 23*b* in the channel frame members 17*b*. Each gate 20*b* has an operating member 26*b* which is operated to pivot the gate to the open position. The trays T2 have side flanges 17*e* engaged in groves 17*f* in the frame 17*b*, so that the trays may be selectively added, depending upon the number of trays desired.

The gates 20*a* and 20*b* are selectively opened by oppositely operating means, including reversible motors 30 (see FIG. 3) having their shafts connected to U-shaped rocker members 31 (see FIGS. 8 and 9) each having arms 31*a* and 31*b* adapted to engage the respective gate operating members 26*a* and 26*b* upon rocking of members 31 in one direction or the other by the reversible motors. Thus, rocking of a selected member 31 in one direction will open a gate 20*a* and in the other direction a gate 20*b* will be opened, to deflect a sheet from path FP by a selected gate to a tray T1 or T2. Such selection of gates and trays may be performed by suitable control means (not shown) included in the printer or in a printer mailbox interface, in a known manner, depending upon the printer.

Infeed means I are provided, as may be necessary depending upon the printer with which the mailbox assembly is associated to carry sheets to the sheet feed path FP, as well as to invert sheets to be supplied to one side or the other of the mailbox, if necessary, or to divert sheets to the stacker tray ST.

The infeed means I includes driven infeed rolls 35*a* (see FIG. 6) rotably supported in a motor support and base frame member 36 in the transport section 12*a* and opposing idler rolls 35*b* supported in the transport section 12*b* and guide plates 37*a* and 37*b*, whereby sheets will be guided into the feed path FP between lowermost feed rolls 19*a* and 19*b* from a sheet inlet 37 which is aligned with the output rolls 3 of the printer.

At their lower ends the plates 37*a* and 37*b* define an inverter chamber 38 in which is pivotally disposed a sheet diverter member 39. This diverter 39, when in the position shown in FIG. 8*a* directs sheets to the upwardly extending path between the infeed rolls 35*a* and 35*b* towards the sheet feed path FP. When in the position shown in FIG. 8*b*, the diverter directs sheets to a pair of invertor rolls 40 whereby, as is well known in the art, the sheet will be either deposited in the stacker tray ST, or, under the control of the usual control means, the invertor rolls 46 may be reversed to cause the sheet to be reversely moved upwardly between the plates 37*a* and 37*b* when sheets are to be fed to the trays T2 as shown in FIG. 8*b*.

Such inversion of sheets is applicable in the case that the output from the printer is being supplied page 1 first for delivery to the trays T1 and, therefore, require inversion for proper delivery of the sheets to the trays T2 so that the jobs or sets of sheets are properly collated. In other applications of the invention, say in the case that the sheet exiting the printer are fed upwardly, the need for and engagement of the infeed means would be different, and in the case that the printer is capable of controlling the printer process so that a job can be fed to the trays T2 last page first, then inversion becomes unnecessary.

Means are provided for actuating the diverter 39, as seen in FIG. 3 wherein a solenoid 40 is illustrated as having connection at 41 to the rockable shaft for the invertor 39. Also shown in FIG. 3 is a drive motor M1 adapted through gearing 42 to drive the invertor rolls 46. The gearing, including the feed roll drive gears 24*a* and idler gears 25*a*, is driven by the motor shown at M2 in FIG. 3. Motor M2 is adapted to drive the output gear 43, and through a set of idler and drive gears 35*c* and 35*d* for the driven infeed rolls 35*a*, to also drive the feed rolls 19*a* as described above.

Each of the actuator members 31 for selectively opening one of the gates under the control of reversible motors 30, the invertor shifting solenoid 40, the infeed drive motor M1 and the transport roller drive motor M2 are connected via a wiring set 44 to a control or interface panel 45 in the transport section 12*a*, and the appropriate control signals for the mailbox may be relayed through this wiring set from the printer or from a controller (not shown) associated with the mailbox.

The specific construction of the gates 20*a* and 20*b* and their relationship with the shafts 18*a* and 18*b*, as well as the construction of the gates and the associated nip rollers 21*a* and 21*b* are more particularly the subject matter of the copending application, Ser. No. 072,028, filed Jun. 7, 1993.

However, it will be noted with reference to FIGS. 8*a* and 8*b* that when the gates 20*a* or 20*b* are in the sheet deflecting position the nip roll 21*a* or 21*b*, which is normally inactive but is carried by the gate, is moved into opposing relation to the feed roll 19*a* or 19*b* and therefore, constitutes, at this position, an added pressure roll for carrying the sheet substantially fully into the tray under the influence of a positive drive. It will be noted that upon opening of a gate, in either section 12*a* or 12*b*, as illustrated in FIGS. 8*a* and 8*b*, the axis of a nip roll 21*a* or 21*b* on the opened gate, as the gate swings open, moves relative to its normal position in the direction for assisting full feeding of the sheet into the tray.

It will also be noted with reference to these views that the gates 20*a* and 20*b* have fingers which at their sheet engaging sides are arched to deflect the leading edge of the sheet into the nip between driven rolls 19*a* and 19*b* and nip rolls 21*a* and 21*b*. In addition, these fingers nest in the gate of the next subjacent module, thereby enabling the overall height of the assembly to be minimized. On the other hand, when the gates are in the normal position the surfaces which extend along the sheet feed path assist in the provision of smooth, continuous sheet guide surfaces provided by webs or ribs formed in the opposing modules as disclosed in the aforementioned U.S. Pat. No. 3,937,459.

From the foregoing it will be seen that the present invention provides a unique arrangement of gates and infeed rolls for transporting sheets selectively to one or the other of the receiver trays which extend from opposite sides of the common sheet feed path defined between the gates and their associated nip rolls, and the scope of the invention will be defined in the appended claims.

We claim:

1. Sheet receiving apparatus comprising a frame structure, trays supported by and extending horizontally from said frame structure in opposite directions, means defining a vertically extended sheet path between said oppositely extending trays, including feed rollers for transporting sheets through said sheet path and gating means for deflecting sheets into said trays from said feed rollers, and double acting actuator means for actuating said gating means to selectively deflect sheets from said feed rollers into trays extending in one direction or the other.

2. Sheet receiving apparatus as defined in claim 1, wherein said gating means includes a pair of oppositely pivotally movable gate members at each tray having fingers opposing one another to define vertically extended guide surfaces.

3. Sheet receiving apparatus as defined in claim 2, wherein said gating means includes a pair of oppositely pivotally movable members at each pair of trays, said double acting actuator means including a bi-directional actuator motor associated with each pair of gating members.

4. Sheet receiving apparatus as defined in claim 1, wherein said gating means includes a pair of oppositely pivotally movable gate members at each pair of trays, said double acting actuator means including a bi-directional actuator motor associated with each pair of gating members.

5. Sheet receiving apparatus as defined in claim 1, including means for inverting sheets being deflected by said gating means into the trays extending in one direction from said sheet feed path.

6. Sheet receiving apparatus as defined in claim 1, said frame structure including side frame members and tray supporting units each supporting trays extending in opposite horizontal directions, said gating means including individual gate members supported by each of said units, and said actuator means including bi-directional motor means for actuating the respective gate members to a sheet deflecting position upon actuation of the motor means in opposite directions.

7. Sheet receiving apparatus as defined in claim 1, said actuation means including a reversible motor, said gating means and said motor having co-engageable means for actuating said gating means in opposite directions.

8. Sheet receiving apparatus as defined in claim 1, said gating means including a pair of frame members pivotally connected at one side and each having a series of vertically spaced gates defining one side of said sheet path, whereby one of said frame members swings away from the other at said sheet path for exposing said gates.

9. Sheet receiving apparatus as defined in claim 1, wherein said feed rollers for transporting sheets through said sheet path includes opposing rollers at opposite sides of said sheet path for moving sheets through said sheet path.

10. Sheet receiving apparatus as defined in claim 1, wherein said feed rollers for transporting sheets through said sheet path includes opposing rollers at opposite sides of said sheet path for moving sheets through said sheet path, and including means for driving the rollers at one side of said sheet path, the rollers at the other side of said sheet path being pressure rollers driven by said rollers at said one side of said sheet path.

* * * * *